United States Patent [19]

Mürrle

[11] 4,015,421

[45] Apr. 5, 1977

[54] MAINSPRING MECHANISM AND SPRING BARREL ASSEMBLY

[75] Inventor: Kurt Mürrle, Pforzheim, Germany

[73] Assignee: Pforzheimer Uhren-Rohwerke Rudolf Wehmer, Pforzheim, Germany

[22] Filed: Dec. 15, 1975

[21] Appl. No.: 640,445

[30] Foreign Application Priority Data

Jan. 23, 1975 Germany ..... 2502562

[52] U.S. Cl. ..... 58/86; 58/59; 58/63; 58/116 R

[51] Int. Cl.[2] ..... G04B 1/16

[58] Field of Search ..... 58/59, 63, 73, 86, 116 R

[56] References Cited

UNITED STATES PATENTS

| | | | |
|---|---|---|---|
| 326,677 | 9/1885 | Sandoz | 58/73 |
| 1,376,078 | 4/1921 | Carlstron | 58/86 |
| 1,467,427 | 9/1923 | Freund | 58/86 |
| 3,673,791 | 7/1972 | Zangg | 58/86 R |
| 3,852,954 | 12/1974 | Bachmann | 58/86 X |

*Primary Examiner*—Ulysses Weldon

[57] ABSTRACT

A spring barrel is rotatably mounted on a barrel arbor. A spring core is non-rotatably connected to said barrel arbor and surrounds the same. A coiled spring is disposed in said barrel and has an inner end secured to said spring core and an outer end secured to said barrel. A ratchet wheel is non-rotatably connected to said spring core on one side of said spring and is formed with ratchet teeth. A locking lever is disposed on that side of said ratchet teeth which is remote from said spring and is frictionally coupled to said spring core and has locking tooth means adjacent to said ratchet teeth. In addition to the spring barrel assembly comprising the above parts, a mainspring mechanism comprises a barrel bridge, in which said barrel arbor is rotatably mounted, first and second stops carried by said bridge and spaced apart in the peripheryl direction of said ratchet wheel, and a winding wheel having winding wheel teeth which are in mesh with said ratchet teeth and protrude from said ratchet teeth on the side remote from said spring. The locking lever is disposed between said first and second stops and is movable against the force of said spring from a first position, in which said locking lever engages said first stop and said locking tooth means interengage with said winding wheel teeth, to a second position, in which said locking lever engages said second stop and said locking tooth means are disengaged from said winding wheel teeth.

8 Claims, 2 Drawing Figures

MAINSPRING MECHANISM AND SPRING BARREL ASSEMBLY

Figure 1:
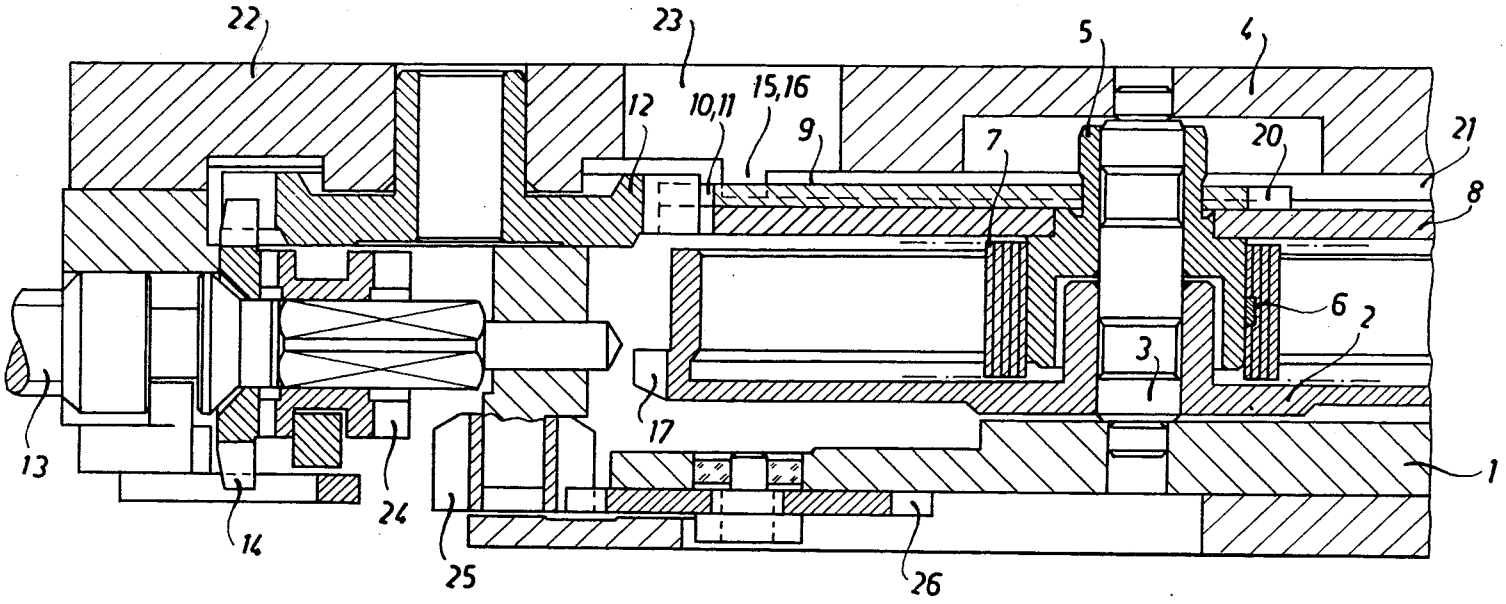

This invention relates to a spring barrel assembly and a ratchet mechanism for watches, particularly wrist watches.

Closed spring barrels assemblies are known, which comprise a barrel, a cover, a barrel arbor, and main spring. These parts are delivered in the form of an assembly. When this assembly is to be installed, the ratchet wheel, its fixing screw, as well as the click and click spring to be mounted on the barrel bridge, are to be mounted too. Open spring barrel assemblies are also known. In these open assemblies, the ratchet wheel rather than a separate spring barrel cover is used to cover the barrel. Where these open barrel assemblies are used, the click and the click spring must also be separately mounted on the barrel bridge. This click acts in most cases on the ratchet wheel but in some cases acts on the winding crown wheel.

It is an object of the invention to provide for watches a spring barrel assembly and ratchet mechanism which can be installed and removed as a unit and requires only a small space and does not require a separate click spring.

In a spring barrel assembly for watches, particularly wrist watches, comprising a spring barrel, a barrel arbor, a spring core secured to said arbor, a ratchet wheel disposed over said spring barrel and secured to said spring core, said object is accomplished in that a radially outwardly extending locking lever is disposed over the ratchet wheel and frictionally coupled to said spring core and has a toothed end portion, a winding crown wheel is provided, which is adapted to mesh with said toothed end portion over said ratchet teeth, two bridge stops are provided to limit the pivotal movement of said locking lever, and said toothed end portion is arranged to disengage said ratchet wheel during a rotation of said winding crown wheel in the spring-winding sense, whereas when the winding operation is terminated the torque exerted by the mainspring tending to unwind causes the toothed end to re-engage the winding crown wheel and the bridge stop limits the unwinding movement. This assembly can be installed as a unit and does not require a separate click spring.

The locking lever may have at one end a circlip-like end portion, which embraces the spring core, and may be formed at the other end with two teeth which are similar to a fork and adapted to engage the teeth of the crown wheel. The bridge stops disposed on both sides of the forked end/portion of the locking lever for engagement thereby may be formed by an annular positioning rib, which is provided on the barrel bridge and interrupted at the release aperture.

Further details of the spring barrel and ratchet assembly according to the invention are shown by way of example on the drawing and will be described hereinafter.

Figure 2:
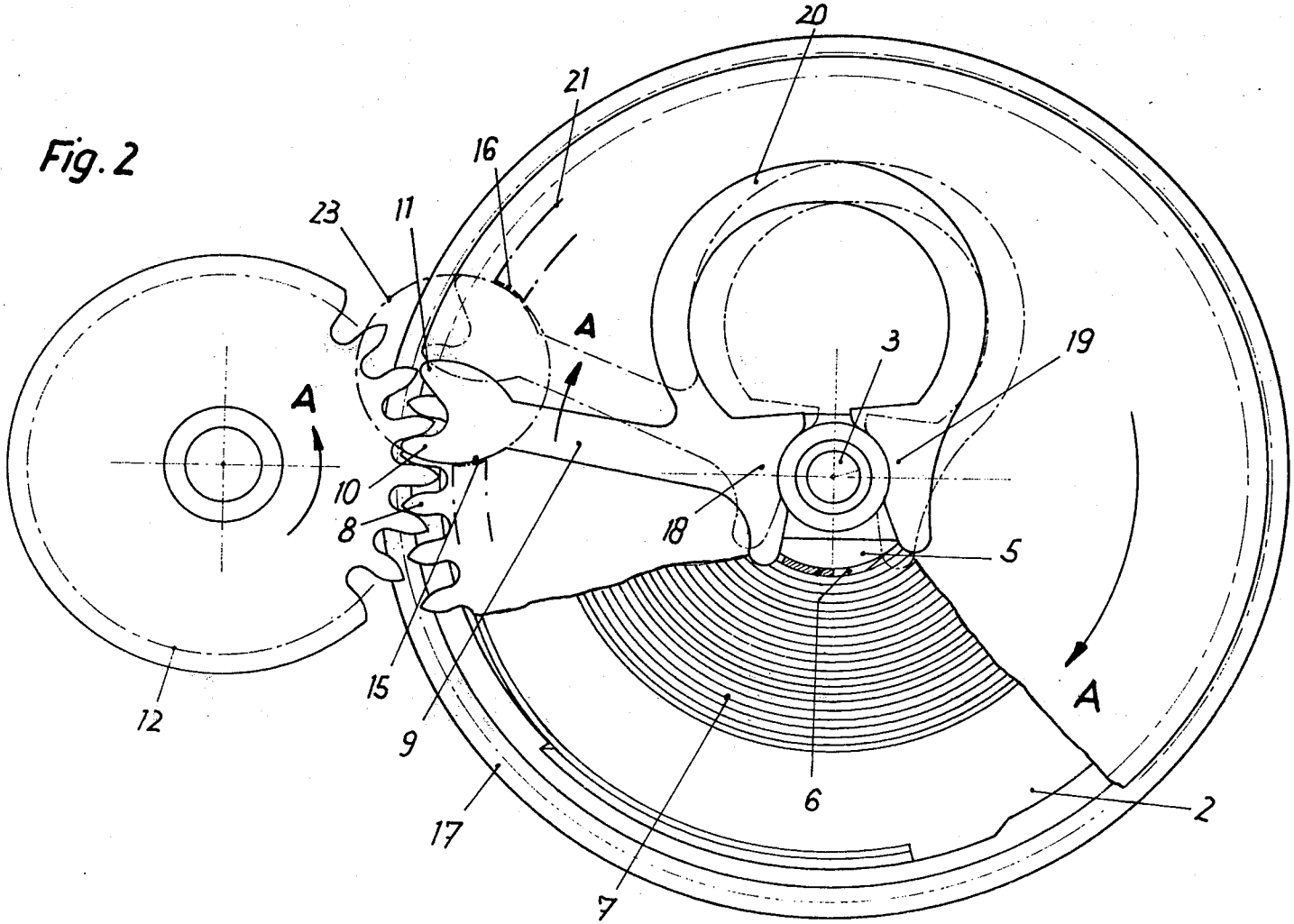

FIG. 1 is a sectional view showing a spring barrel assembly provided with a ratchet wheel and winding crown wheel, and FIG. 2 is a top plan view showing the watch movement.

As is apparent from the drawing, a spring barrel 2 is disposed between a plate 1 and a barrel bridge 4 and is rotatably mounted on a barrel arbor 3, which is rotatably mounted in said plate 1 and bridge 4. The barrel arbor 3 is surrounded by a spring core 5, which is provided with a hook 6 for connection to the mainspring 7. A ratchet wheel 8 is fixed to the spring core 5 and covers the spring barrel 2. A locking lever 9 lies on the ratchet wheel 8 and is formed at its inner end with a circlip, which embraces the spring core 5 and is frictionally coupled thereto. At its outer end, the locking lever is provided with a two teeth 10, 11, which mesh with the winding crown wheel 12 over the teeth of the ratchet wheel 8. To wind the spring, the winding pinion 14 is rotated by its shaft 13 to rotate the winding crown wheel 12 in direction A so that the spring is wound up by means of the ratchet wheel 8 and the spring core 5. At the same time, the locking lever 9 is moved from the bridge stop 15 also in the direction A into engagement with the bridge stop 16 to assume a position which is indicated by a dash-dot lines and in which the teeth of the locking lever are disengaged from the teeth of the winding crown wheel 12 and the spring can be freely wound. When the winding operation is terminated, the spring rotates the ratchet wheel 8 in the sense which is opposite to the sense A and the locking lever 9 owing to its frictional coupling to the spring core is moved to a position in which it engages the stop 15 and its locking tooth 10 engages the teeth of the winding crown wheel 12 so that a rapid unwinding of the spring 7 is prevented. The spring 7 can then unwind in known manner in that a drive of the movement is derived from the gear 17 secured to the spring barrel. A short movement of the ratchet wheel 8 opposite to direction A is desired in a predetermined order of magnitude in order that the stress of the mainspring 7 is slightly reduced from the maximum which is obtained when the spring is fully wound. When the mainspring is under maximum stress, the movement might tend to bounce as a result of an overshooting of the balance.

The locking lever 9 is formed at one end with a circlip embracing the spring core 5 and at its other end is formed like a fork with two teeth 10, 11 for engaging the winding crown wheel 12. At its circlip end, the locking lever 9 is provided with an arcuate spring portion 20, which connects the two jaws 18, 19, which embrace the spring core 5. At the forked end of the lever 9, the tooth 10 is engageable with the stop 15 to resist an unwinding of the spring 7 and the second tooth 11 is engageable with the stop 16 when the locking lever is swung out. The two bridge stops 15, 16 disposed on opposite sides of the locking lever 9 and engageable by the forked end 10, 11 thereof are formed by the annular positioning rib 21, which is interrupted at the release aperture 23.

As its name implies, the release aperture 23 permits of a gradual release of the main spring 7 for repairs. For this purpose, a pointed implement is introduced through the aperture 23 and is used to move the forked end 10, 11 of the locking lever 9 out of engagement with the winding crown wheel 12. When the crown of the watch is braked at the same time the spring 7 can slowly unwind.

The hands of the watch are set in known manner from the pulled winding shaft 13 by means of the clutch pinion 24, and the setting wheel train 25, 26.

What is claimed is:

1. In an arrangement for prevention of the back-turning movement of the mainspring of the spring casing for small watches comprising:

a barrel arbor, a spring barrel rotatably mounted on said barrel arbor, a spring core non-rotatably connected to said barrel arbor and surrounding the same, a coiled spring disposed in said barrel and having an inner end secured to said spring core and an outer end secured to said barrel a ratchet wheel non-rotatably connected to said spring core on one side of said spring and formed with ratchet teeth, and a locking lever preventing rapid unwinding of the mainspring the improvement comprising; including said arrangement in a modular unit and locating said locking lever in a single plane on the side of said ratchet wheel remote from said spring casing, said locking lever rotatably disposed on said spring core.

2. A spring barrel assembly as set forth in claim 1, in which said locking lever is provided at one end with circlip means embracing said spring core.

3. A spring barrel assembly as set forth in claim 1, in which said circlip means comprise two jaws in frictional engagement with said spring core and an arcuate resilient portion connecting said jaws.

4. In a watch, a mainspring mechanism comprising a barrel bridge, a barrel arbor rotatably mounted in said barrel bridge a spring barrel rotatably mounted on said barrel arbor, a spring core non-rotatably connected to said barrel arbor and surrounding the same, a coiled spring disposed in said barrel and having an inner end secured to said spring core and an outer end secured to said barrel, a ratchet wheel disposed between said main spring and said barrel bridge and non-rotatably connected to said spring core and formed with ratchet teeth, first and second stops carried by said bridge and spaced apart in the peripheral direction of said ratchet wheel, a winding wheel having winding wheel teeth which are in mesh with said ratchet teeth and protrude from said ratchet teeth on the side remote from said spring, and a locking lever which is disposed between said first and second stops on that side of said ratchet wheel which is remote from said spring and is frictionally coupled to said spring core and has locking tooth means adjacent to said ratchet teeth, said locking lever being movable against the force of said spring from a first position, in which said locking lever engages said first stop and said locking tooth means interengage with said winding wheel teeth, to a second position, in which said locking lever engages said second stop and said locking tooth means are disengaged from said winding wheel teeth.

5. A mainspring mechanism as set forth in claim 4, in which said locking lever is provided at one end with circlip means embracing said spring core.

6. A mainspring mechanism as set forth in claim 5, in which said circlip means comprise two jaws in frictional engagement with said spring core and an arcuate resilient portion connecting said jaws.

7. A mainspring mechanism as set forth in claim 4, in which said locking tooth means comprise a first tooth which is arranged to engage said winding wheel teeth and first stop in said first position and a second tooth which is arranged to engage said second stop in said second position.

8. A mainspring mechanism as set forth in claim 4, in which said bridge extends beyond said locking tooth means and is formed with an aperture in register with said locking tooth means and is provided on its side facing said barrel with an annular positioning rib which has end portions terminating at said aperture on opposite sides thereof and forming said first and second stops.

* * * * *